US008339023B2

(12) United States Patent
Shirakawa et al.

(10) Patent No.: US 8,339,023 B2
(45) Date of Patent: Dec. 25, 2012

(54) DISCHARGE LAMP

(75) Inventors: Osamu Shirakawa, Imabari (JP); Keisuke Nakazato, Imabari (JP)

(73) Assignee: Harison Toshiba Lighting Corp., Imabari-shi (JP)

( * ) Notice: Subject to any disclaimer, the term of this patent is extended or adjusted under 35 U.S.C. 154(b) by 56 days.

(21) Appl. No.: 12/747,335

(22) PCT Filed: Jul. 4, 2008

(86) PCT No.: PCT/JP2008/062200

§ 371 (c)(1), (2), (4) Date: Jun. 10, 2010

(87) PCT Pub. No.: WO2009/075121

PCT Pub. Date: Jun. 18, 2009

(65) Prior Publication Data

US 2010/0270921 A1 Oct. 28, 2010

(30) Foreign Application Priority Data

Dec. 12, 2007 (JP) ..... 2007-320506

(51) Int. Cl.
*H01J 9/32* (2006.01)

(52) U.S. Cl. ..... 313/318.07; 313/623

(58) Field of Classification Search ..... 313/623, 313/318.07

See application file for complete search history.

(56) References Cited

U.S. PATENT DOCUMENTS 4,851,733 A * 7/1989 Kuus et al. ..... 313/331
5,430,353 A * 7/1995 Feldman et al. ..... 313/623
5,936,350 A * 8/1999 Yoshida et al. ..... 313/631
6,137,228 A * 10/2000 Aizawa et al. ..... 313/631
6,354,900 B1 * 3/2002 Ohshima et al. ..... 445/26
2003/0042856 A1 * 3/2003 Kaneko et al. ..... 313/639
2005/0200279 A1 * 9/2005 Muto et al. ..... 313/623
2009/0121635 A1 * 5/2009 Nagamachi et al. ..... 313/631
2010/0109528 A1 5/2010 Shirakawa (Continued)

FOREIGN PATENT DOCUMENTS

DE 10 2004 003 041 A1 8/2005

(Continued)

OTHER PUBLICATIONS

U.S. Appl. No. 12/674,360, filed Feb. 19, 2010, Deguchi, et al.

(Continued)

*Primary Examiner* — Nimeshkumar Patel

*Assistant Examiner* — Christopher Raabe

(74) *Attorney, Agent, or Firm* — Oblon, Spivak, McClelland, Maier & Neustadt, L.L.P.

(57) ABSTRACT

A discharge lamp includes an airtight tube including a light-emitting unit in which a space is formed and seal portions formed at least on one end of the light-emitting unit, a discharge medium including a metal halide and a rare gas sealed in the light-emitting unit, a metal foil sealed into the seal portion, and a pair of electrodes one ends of which are overlapped and connected to the metal foil and the other ends of which are provided such that they are led into the space of the light-emitting unit and arranged in opposition to each other. A concavity is formed on at least a portion of the back surface side of the metal foil on which the electrode is overlapped, and a compression distortion is formed on the seal portion in the vicinity of the concavity.

4 Claims, 3 Drawing Sheets

U.S. PATENT DOCUMENTS

2010/0259169 A1* 10/2010 Shirakawa et al. ..... 313/623

FOREIGN PATENT DOCUMENTS

| | | | |
|---|---|---|---|
| EP | 1 320 120 | A2 | 6/2003 |
| EP | 1 320 120 | A3 | 6/2003 |
| GB | 2 351 603 | A | 1/2001 |
| JP | 2000 288755 | | 10/2000 |
| JP | 2006 196267 | | 7/2006 |
| JP | 2007 87683 | | 4/2007 |
| JP | 2007 200713 | | 8/2007 |
| JP | 2007 227329 | | 9/2007 |
| WO | WO 2007086527 | A1 * | 8/2007 |

OTHER PUBLICATIONS

Extended European Search Report issued Apr. 12, 2011, in Patent Application No. 08790881.0.

* cited by examiner

DISCHARGE LAMP

TECHNICAL FIELD

The present invention relates to a discharge lamp used for vehicle headlights, projectors and the like.

BACKGROUND ART

The discharge lamp used for vehicle headlights is known from JP-A 2007-87683 (KOKAI) (Patent Reference 1) and WO 2007/086527 A1 (Patent Reference 2), and it has a discharge medium which is comprised of a metal halide of sodium, scandium, zinc or the like and a rare gas such as xenon, sealed into a discharge space of an airtight tube with both ends of which are sealed and generates a predetermined light by applying a voltage to electrodes connected to metal foils which are attached to sealing portions by sealing to excite the discharge medium.

But, this type of discharge lamp has a problem that the metal halide sealed in the discharge space reaches to the metal foil through a small gap between the electrode axis and the glass to exfoliate the glass and the metal foil configuring a seal portion, resulting in easily causing crack leak (hereinafter called as foil leak). This problem becomes more conspicuous when a coil is wound around the electrode axis.

According to Patent Reference 1, a hole is formed in the metal foil, and the glass which configures the seal portion is entered into the hole to improve the adhesiveness between the metal foil and the seal portion, thereby suppressing occurrence of foil leak. According to Patent Reference 2, the metal foil surface is fabricated to have an irregular shape by laser to improve the adhesiveness with the seal portion, thereby suppressing the occurrence of foil leak.

Patent Reference 1: JP-A 2007-87683 (KOKAI)

Patent Reference 2: WO 2007/086527 A1

DISCLOSURE OF INVENTION

Technical Problem

But, the above-described measures against the foil leak cannot meet a demand for a longer life of the discharge lamp, and additional improvement is necessary.

The object of the present invention is to provide a discharge lamp capable of suppressing the occurrence of foil leak.

Technical Solution

According to an aspect of the present invention, there is provided a discharge lamp, comprising an airtight tube including a light-emitting unit having a space formed therein and a seal portion formed on at least one end of the light-emitting unit; a discharge medium containing a metal halide and a rare gas sealed in the light-emitting unit; a metal foil sealed into the seal portion; and a pair of electrodes, the electrode having one end being overlapped and connected to the metal foil and the other end being led into the space of the light-emitting unit so as to be arranged to face each other, wherein a concavity is formed on at least a portion of the back surface side of the metal foil on which the electrode is overlapped, and a compression distortion is formed on the seal portion in the vicinity of the concavity.

Advantageous Effect

The invention can adequately suppress the occurrence of foil leak.

MODE FOR CARRYING OUT THE INVENTION

First Embodiment

Figure 1:
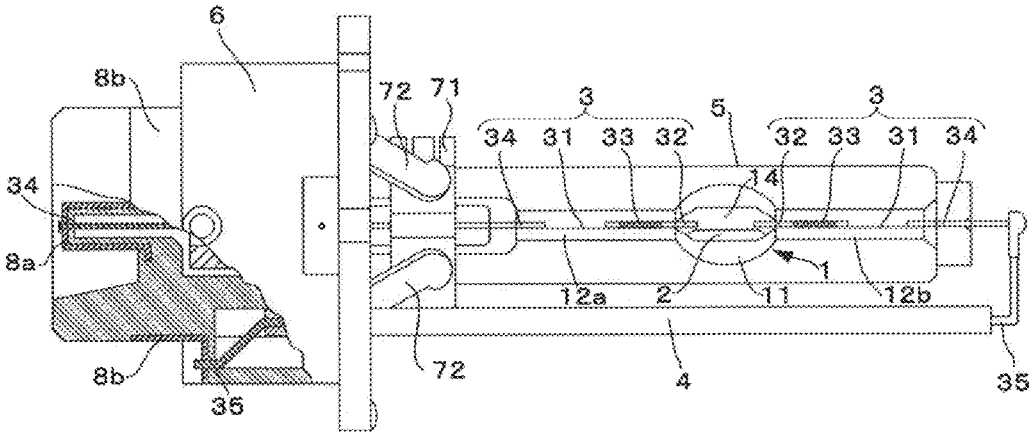
FIG. 1 is a side view illustrating a first embodiment of the metal halide lamp according to the invention.
Figure 2:
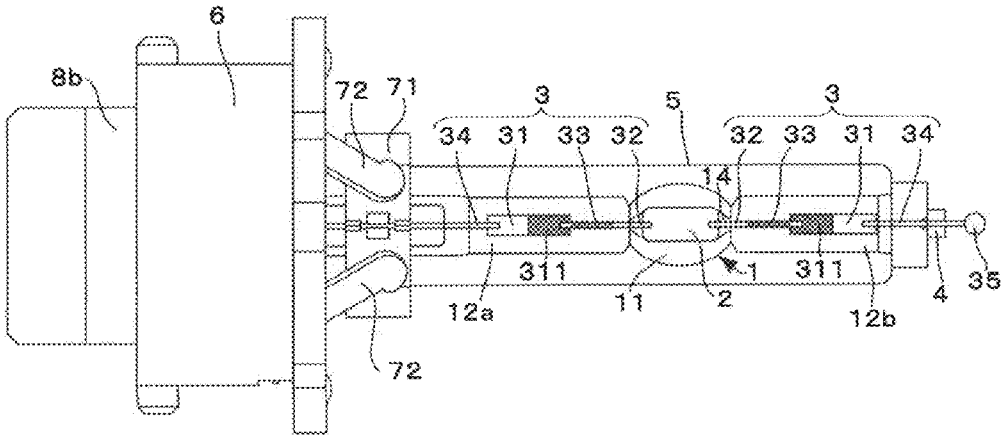
FIG. 2 is a top view illustrating the first embodiment of the metal halide lamp according to the invention.

A metal halide lamp according to one embodiment of the discharge lamp of the invention is described below with reference to the drawings. FIG. 1 is a side view illustrating a first embodiment of the metal halide lamp according to the invention, and FIG. 2 is a top view illustrating the first embodiment of the metal halide lamp according to the invention.

The metal halide lamp has an airtight tube 1 as a main portion. The airtight tube 1 has an elongate shape in a lamp tube axis direction with an almost elliptical light-emitting unit 11 formed at its approximate center. Seal portions 12*a* and 12*b* which are pinch sealed into a plate-like shape are formed at both ends of the light-emitting unit 11. The airtight tube 1 is desirably made of, for example, a material such as quartz glass having heat resistance and translucency.

A discharge space 14 which has an almost cylindrical shape at the center and its both ends tapered is formed within the light-emitting unit 11. The discharge space 14 has preferably a volume of 10 $mm^3$ to 40 $mm^3$ when it is used for vehicle headlights.

A discharge medium comprising a metal halide 2 and a rare gas is sealed in the discharge space 14.

The metal halide 2 is constituted by sodium iodide (NaI), scandium iodide ($ScI_3$), zinc iodide ($ZnI_2$) and indium bromide (InBr). But, the metal halide 2 is not limited to the above combination. It may be constituted by adding halides of tin and/or potassium, or changing the combination of halogens to be bonded to the metal.

As the rare gas, xenon which has high luminous efficiency just after the startup and functions mainly as a starting gas is sealed. The xenon has a pressure of not less than 5 atm at normal temperature (25° C.) and desirably 10 to 20 atm when its use is designated for vehicle headlights. As the rare gas, neon, argon, and krypton can be used in addition to the xenon, and they can also be used in combination.

The discharge space 14 does not substantially contain mercury. This "does not substantially contain mercury" means that it is optimum to contain no mercury but it is allowed to contain mercury in an amount equivalent to substantially no enclosure in comparison with a conventional mercury-containing metal halide lamp, e.g. less than 2 mg, or preferably not more than 1 mg of mercury per 1 mL.

Electrode mounts 3 are sealed in the seal portions 12*a* and 12*b*. The electrode mount 3 comprises a metal foil 31, an electrode 32, a coil 33 and a lead wire 34.

For example, the metal foil 31 is a thin metal plate made of molybdenum, and a worked portion 311 is formed on its front and back surfaces on the side of the light-emitting unit 11. The worked portion 311 has plural hemispherical recesses arranged by the laser irradiation (for details, see WO 2007/086527 A1). Diffusion of the metal halide 2 to the ends of the metal foil 31 in its width direction is delayed by the worked portion 311, so that the foil leak is suppressed.

The electrode 32 is a thoriated tungsten electrode which has thorium oxide doped to tungsten. A diameter R of the electrode 32 can be determined to be, for example, not less than 0.30 mm but not more than 0.40 mm in practical use. One end of the electrode 32 is connected to the metal foil 31 on the side of the light-emitting unit 11, and the other end is arranged within the discharge space 14 to face the opposed end of the other electrode 32 with a prescribed interelectrode distance between them. For the vehicle headlights, the prescribed interelectrode distance is desirably about 4.2 mm in appearance, namely it is not an actual distance but an appearance distance in the lamp.

The electrode is not limited to the straight rod shape as in this embodiment but may have a non-straight rod shape having a large diameter at a leading end or a shape having a different size between a pair of electrodes of a direct current lighting type. And, the electrode 32 may be a doped tungsten electrode or a rhenium-tungsten electrode.

The coil 33 is made of, for example, doped tungsten and wound in a spiral shape around the shaft portion of the electrode 32 which is sealed in the seal portions 12*a* and 12*b*. But, the coil 33 is not wound around the shaft portion of the electrode 32 connected to the metal foil 31. To design the coil 33, the coil pitch is not more than 300%, and the coil-wound length is desirably not less than 60% with respect to the electrode sealing length.

For example, the lead wire 34 is made of molybdenum and its one end is connected to the metal foil 31. On the other hand, the other end of the lead wire 34 is extended to the exterior of the airtight tube 1 along the tube axis. And, one end of an L-shape support wire 35 made of nickel is connected to the lead wire 34 which is extended toward the front end of the lamp. The other end of the support wire 35 is extended toward a socket 6 described later, and the support wire 35 parallel to the tube axis is covered by a sleeve 4 made of ceramics.

A cylindrical outer tube 5 is disposed concentrically with the above-configured airtight tube 1 along the tube axis to cover the exterior of the airtight tube 1. They are connected by melting both ends of the airtight tube 1 and the outer tube 5. And, for example, one or a mixture of nitrogen and a rare gas such as neon, argon, xenon or the like can be sealed into the space between the airtight tube 1 and the outer tube 5. The outer tube 5 is desirably provided with an ultraviolet shielding characteristic by adding an oxide of titanium, cerium, aluminum or the like to a quartz glass.

The socket 6 is connected to one end of the airtight tube 1 to which the outer tube 5 is connected. They are connected by attaching a metal band 71 to the outer circumferential surface of the outer tube 5 which is arranged close to the socket 6 and pinching the metal band 71 with metal tongue-shaped pieces 72 which are formed at an open end of the socket 6 on the airtight tube 1 holding side. And, the socket 6 has a bottom terminal 8*a* on its bottom and a side terminal 8*b* on its side, and they are respectively connected with the lead wire 34 and the support wire 35.

The above-configured metal halide lamp is lit by connecting a lighting circuit to the bottom terminal 8*a* and the side terminal 8*b*. This lamp for vehicle headlights is arranged with the tube axis in a substantially horizontal state and lit with electric power of about 35 W at a stable time and about 75 W at the time of start up which is not less than two times in comparison with the power of the stable time.

Figure 3:
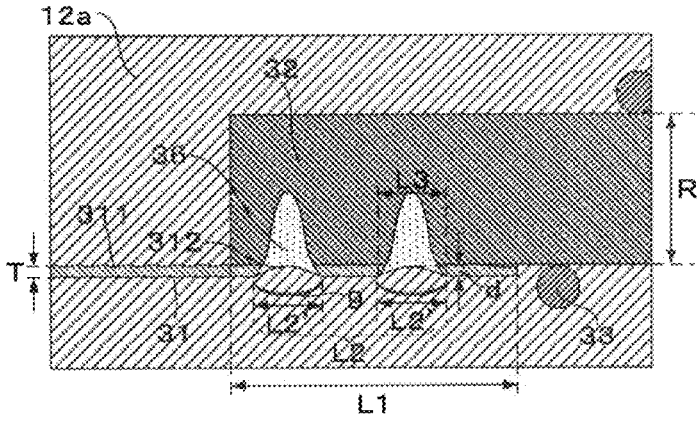
FIG. 3 is a diagram illustrating a cross section along the tube axis direction in the vicinity of the bonded portion between a metal foil and an electrode.

A bonded portion and its vicinity between the metal foil 31 and the electrode 32 are described in detail with reference to FIG. 3 and FIG. 4. FIG. 3 is a diagram illustrating a cross section along the tube axis direction of the bonded portion and its vicinity between the metal foil and the electrode, and FIG. 4 is a diagram illustrating a cross section perpendicular to the tube axis direction of the bonded portion and its vicinity between the metal foil and the electrode.

Figure 4:
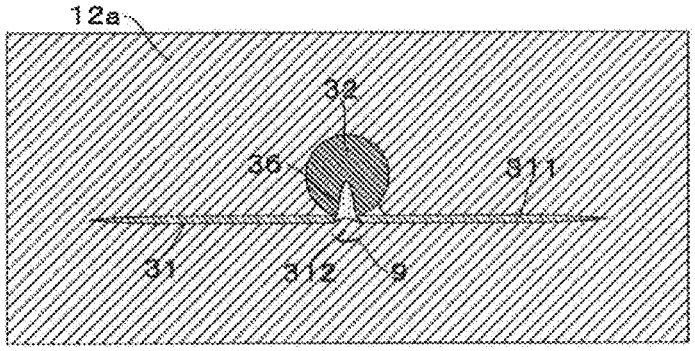
FIG. 4 is a diagram illustrating a cross section perpendicular to the tube axis direction in the vicinity of the bonded portion between the metal foil and the electrode.

It is apparent from FIGS. 3 and 4 that the metal foil 31 and the electrode 32 are connected by forming melted portions 36 at portions (overlapped portions) where they are partly lapped over mutually. The melted portions 36 are huge metal crystals which are formed by so called laser welding which irradiates the electrode 32 from the back side of the metal foil 31 with laser beam by using a YAG laser or the like.

Concavities 312 are formed on the back side of the metal foil 31, namely the melted portions 36, at the overlapped portion of the electrode 32 and the metal foil 31. As a result, compression distortions 9 are formed in the vicinity of the concavities 312 of the seal portions 12*a* and 12*b*. The compression distortions 9 suppress the seal portions 12*a* and 12*b* and the metal foil 31 from exfoliating, and foil leak is suppressed.

In this case, it is desirable that an overlapped length (length of the overlapped portions) L1 of the metal foil 31 and the electrode 32 and a tube-axis-direction length L2 (a sum of respective lengths L2' when plural concavities 312 are formed) of the concavity 312 satisfy $0.2 \leqq L2/L1$. Thus, the above-described action and effect become high, and the effect of suppressing the foil leak is improved.

In this embodiment, two positions are undergone the laser welding, so that the concavity 312 is formed at two positions. Therefore, the compression distortion 9 is also formed at two positions in accordance with the concavities 312. Therefore, a tensile stress resulting from tensile distortion caused in the vicinity of the compression distortions 9 is dispersed, and occurrence of a crack or the like due to the tensile stress can be suppressed. To form the plural compression distortions 9 as described above, it is adequate to form the individual concavities 312 separately from one another so that they do not overlap.

Here, the concavities 312 are formed by a process of sealing the electrode mount 3 into the seal portions 12*a* and 12*b*. It is confirmed that if the concavities 312 are relatively large and have a depth, they can be formed easily.

Specifically, when the electrode 32 has a diameter R of 0.30 mm or more and 0.40 mm or less and the concavities 312 are approximately circular-shaped recesses (indicating the inclusion of an elliptical shape which is a substantially perfect circule) as in this embodiment and have a depth d of 0.01 mm or more and a length L3 of 0.1 mm or more (preferably, $d \geqq 0.05$ mm and $L3 \geqq 0.2$ mm), the compression distortion 9 tends to remain in the seal portions 12*a* and 12*b*. The cause is considered that the formation of the compression distortion 9 is related to the flow of the glass into the concavities 321 at the time of sealing.

The upper limit of the depth d is limited by the thickness of the metal foil 31, and the upper limit of the width L3 is limited by the length L1 of the overlapped portion.

The formation of the compression distortion 9 is somewhat influenced by the thickness of the seal portions 12*a* and 12*b* and a seal pressure. Incidentally, the compression distortion 9 is not formed by the recesses which are based on the melted portion having substantially no depth as in JP-A 2006-196267 (KOKAI). And, in this embodiment, the worked portion 311 which is configured to have the arrangement of the hemispherical recesses on the front and back surfaces of the metal foil 31 is formed, but the compression distortion 9 is not formed on the seal portions 12*a* and 12*b* when the recesses have a size and depth of the level described above.

Examples

Figure 5:
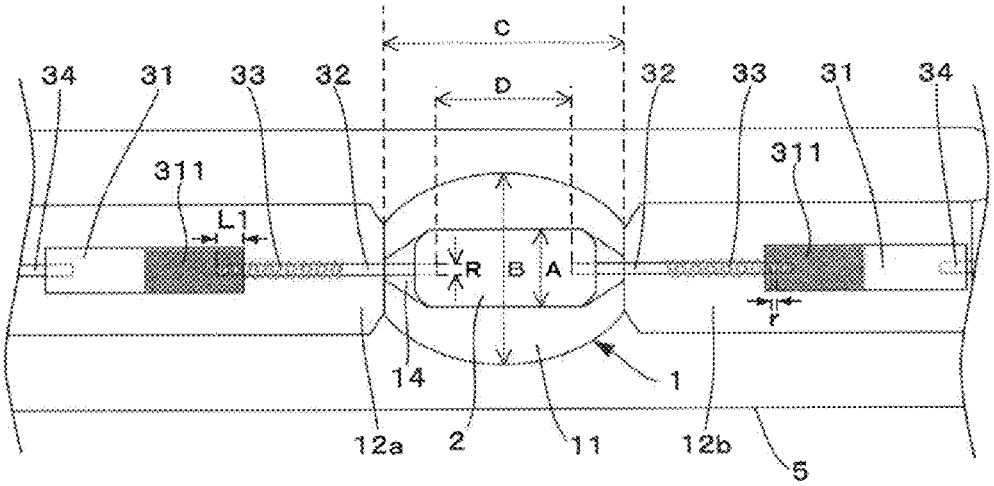
FIG. 5 is a diagram illustrating an example of the metal halide lamp of FIG. 1.

FIG. 5 is a diagram illustrating an example of the metal halide lamp of FIG. 1. The following test is performed with the size and materials according to the same specifications unless otherwise specified.

Electric discharge tube 1: Made of quartz glass, discharge space 14 has an inner volume of 27.5 $mm^3$, inner diameter A of 2.5 mm, outer diameter B of 6.2 mm, and sphere length C in longitudinal direction of 7.8 mm, Metal halide 2: $ScI_3$, NaI, $ZnI_2$, InBr, total=0.4 mg, Rare gas: xenon=13.5 atm, Mercury: 0 mg, Metal foil 31: Made of molybdenum, length×width=6.5 mm×1.5 mm, thickness T=0.02 mm, overlapped length L1=0.9 mm, Worked portion 311: Diameter of recess=0.03 mm, depth=0.0025 mm, working area: front and back surfaces, Concavity 312: Two formed, diameter (=L3)=0.3 mm, depth d=0.1 mm, Electrode 32: Made of thoriated tungsten, diameter R=0.38 mm, Interelectrode distance D=42 mm (actual interelectrode distance=3.75 mm), Coil 33: Made of doped tungsten, wire diameter=0.06 mm, pitch=250%, coil-wound length=3.2 mm, Lead wire 34: Made of molybdenum, diameter=0.6 mm, Compression distortion 9: Remained in seal portions 12*a* and 12*b* in the vicinity of the concavity 312, tube-axis-direction length L2 (≈L2'×2)=0.6 mm, compression stress=50 $kg/cm^2$.

The lamp of this example can suppress the occurrence of foil leak up to about 3000 hours, and a long-life metal halide lamp could be realized. The cause is considered that the compression distortion 9 is formed on the seal portions 12*a* and 12*b* in the vicinity of the concavities 312 formed when the metal foil 31 and the electrode 32 are welded, the adhesiveness to the glass is enhanced on the back surface side of the overlapped portion of the metal foil 31, and it became difficult to exfoliate the seal portions 12*a* and 12*b* and the metal foil 31.

Figure 6:
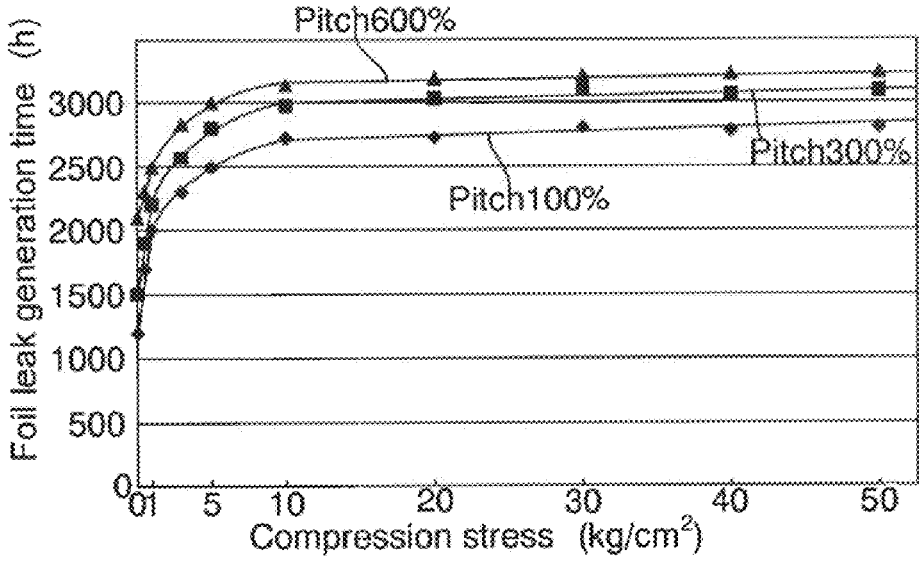
FIG. 6 is a diagram illustrating an intensity of compression stress and generation time of foil leak.

Then, the depth d and the tube-axis-direction length L2 of the concavity 312 were changed, and the generation time of foil leak was tested while an intensity of compression stress was varied. The results are shown in FIG. 6. The test condition is a flash on and off cycle on EU120-minute mode specified in JEL215 which is a standard of HID light sources for vehicle headlights. Thirty lamps were tested, and the foil leak generation time means time when one of the thirty lamps had first foil leak. And, the types and stress values of the compression distortions 9 were checked according to a sensitive color plate method (a method of discriminating a state of distortion caused in the glass by an optical path difference of light).

It is apparent from the results that there is a tendency that the foil leak generation time becomes long as the compression stress is larger, particularly 10 $kg/cm^2$ or more, and when the compression stress is 10 $kg/cm^2$ or more, a high effect against the foil leak can be obtained. This tendency does not change even if the pitch of the coil 33 is changed in order to change the ease of entry of the metal halide 2. Therefore, it is adequate to form such that a stress value of the compression distortion 9 becomes 10 $kg/cm^2$ or more. But, if the compression stress is excessively large, the tensile stress also increases, so that a crack is caused starting from the boundary between the compression stress and the tensile stress, possibly resulting in leakage. Therefore, the compression stress is desirably not more than 300 $kg/cm^2$.

When a relationship L2/L1 between the overlapped length L1 between the metal foil 31 and the electrode 32 and the tube-axis-direction length L2 of the concavity 312 meets $0.2 \leqq L2/L1$, and desirably $0.5 \leqq L2/L1$, high adhesiveness can be normally maintained over a wide range on the overlapped portion where the adhesiveness to the glass tends to become low, so that it is also effective against the foil leak.

Therefore, in this example, the concavities 312 are formed on the back surface of the metal foil 31 on which the electrode 32 is lapped, and the compression distortion 9 is formed in the seal portions 12*a* and 12*b* in the vicinity of the concavities 312. Thus, the seal portions 11*a* and 12*b* and the metal foil 31 become difficult to exfoliate, and the occurrence of foil leak can be suppressed.

And, a high effect against the foil leak can be obtained by determining the compression stress generated in the seal portions 12*a* and 12*b* to be 1.0 $kg/cm^2$ or more. In addition, when it is determined that the overlapped length between the metal foil 31 and the electrode 32 is L1 and the tube-axis-direction length of the compression distortion 9 is L2 and $0.2 \leqq L2/L1$ is satisfied, high adhesiveness can be maintained over a wide range on the overlapped portion where adhesiveness tends to become low, and a high effect can be obtained against the foil leak.

When it is determined that the concavity 312 is an approximately circular shaped recess, has a depth d and a length L3 and satisfies $d \geqq 0.01$ mm and $L3 \geqq 0.1$ mm, the compression distortion 9 can be easily formed in the seal portions 12*a* and 12*b*, and the compression stress can also be enhanced.

Second Embodiment

Figure 7:
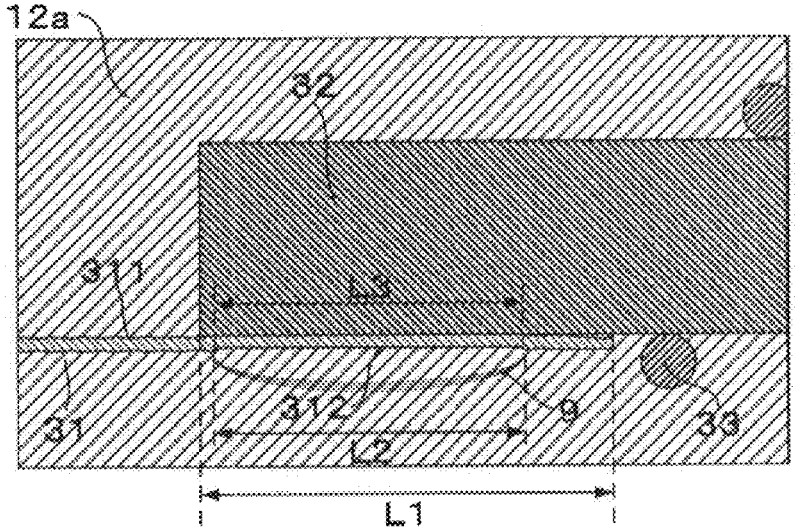
FIG. 7 is a view illustrating the metal halide lamp of a second embodiment of the invention.

FIG. 7 is a diagram illustrating the metal halide lamp according to a second embodiment of the invention. In the second embodiment and following, like or equivalent component parts corresponding to those of the metal halide lamp of the first embodiment described above are denoted by like reference numerals, and their descriptions will be omitted.

In the second embodiment, the metal foil 31 and the electrode 32 are mutually connected by resistance welding to form the concavity 312 which is long in the tube axis direction on the back side of the overlapped portion between the electrode 32 and the metal foil 31, thereby forming the compression distortion 9 on the seal portions 12*a* and 12*b* in the vicinity of the concavity 312. In this case, when it is determined that the concavity 312 has a depth d and a diameter L3 and satisfies $d \geqq 0.005$ mm and $L3 \geqq 0.2$ mm (preferably, $d \geqq 0.01$ mm and $L3 \geqq 0.4$ mm), the compression distortion 9 long in the tube axis direction tends to be formed. By forming the above large concavity 312, a large and strong compression distortion 9 can be formed, and an effect of suppressing foil leak becomes high.

Therefore, this embodiment can suppress the occurrence of foil leak similar to the first embodiment.

Although the present invention has been described in detail above by reference to the specific embodiment of the invention, the invention is not limited to the embodiment described above. It is to be understood that modifications and variations of the embodiment can be made without departing from the spirit and scope of the invention.

For example, the concavity 312 is formed on the overlapped portion between the metal foil 31 and the electrode 32 by the laser welding in the first embodiment and by the resistance welding in the second embodiment. But, the concavity 312 may be formed separately by mechanical means after the metal foil 31 and the electrode 32 are connected by performing a connection method, which does not form the concavity 312 on the overlapped portion between the metal foil 31 and the electrode 32, such as the laser welding method described in, for example, JP-A 2000-288755 (KOKAI).

What is claimed is:

1. A discharge lamp, comprising:

an airtight tube comprising:

a light-emitting unit having a space formed therein, and a seal portion formed on an end of the light-emitting unit;

a discharge medium containing a metal halide and a rare gas sealed in the light-emitting unit;

a metal foil sealed in the seal portion;

an electrode comprising:

a first end being overlapped and connected to the metal foil, the metal foil having a concavity at a part overlapped with the electrode on a back surface side of the metal foil in a direction from the metal foil toward the electrode, and a second end being led into the space of the light-emitting unit; and a distorted portion formed on the concavity in the seal portion by a compression distortion caused by formation of the concavity, wherein the concavity is an approximately circular shaped recess, and when its depth is d and length is L3, $d \geqq 0.01$ mm and $L3 \geqq 0.1$ mm are satisfied.

2. The discharge lamp according to claim 1, wherein the electrode is connected to the metal foil by laser welding, and the concavity is formed as plural concavities on the back surface of the metal foil.

3. The discharge lamp according to claim 1, wherein the part of the metal foil overlapped with the electrode has a length L1, the concavity has a tube-axis-direction length L2, and a relationship $0.2 \leqq L2/L1$ is satisfied.

4. The discharge lamp according to claim 1, wherein a compression stress resulting from the compression distortion is 1.0 kg/cm$^2$ or more.

* * * * *